US007691320B2

(12) United States Patent
Heinrich et al.

(10) Patent No.: US 7,691,320 B2
(45) Date of Patent: Apr. 6, 2010

(54) GAS SUPPLY SYSTEM FOR A METALLURGICAL FURNACE AND OPERATING METHOD FOR SAID SYSTEM

(75) Inventors: Peter Heinrich, Geldern (DE); Manfred Schubert, Oberhausen (DE); Rolf Best, Gladbeck (DE)

(73) Assignee: SMS Demag AG, Düsseldorf (DE)

( * ) Notice: Subject to any disclaimer, the term of this patent is extended or adjusted under 35 U.S.C. 154(b) by 782 days.

(21) Appl. No.: 10/534,944

(22) PCT Filed: Oct. 2, 2003

(86) PCT No.: PCT/EP03/10920

§ 371 (c)(1),
(2), (4) Date: May 13, 2005

(87) PCT Pub. No.: WO2004/046390

PCT Pub. Date: Jun. 3, 2004

(65) Prior Publication Data

US 2006/0038327 A1 Feb. 23, 2006

(30) Foreign Application Priority Data

Nov. 16, 2002 (DE) ..... 102 53 535

(51) Int. Cl.
*C21C 5/48* (2006.01)

(52) U.S. Cl. ..... 266/47; 266/217; 266/268

(58) Field of Classification Search ..... 266/217, 266/265, 268, 47
See application file for complete search history.

(56) References Cited

U.S. PATENT DOCUMENTS

| | | | | |
|---|---|---|---|---|
| 3,851,866 | A * | 12/1974 | Knuppel et al. | 266/222 |
| 4,435,211 | A | 3/1984 | Schwartz et al. | |
| 4,824,080 | A | 4/1989 | Tommaney | |

FOREIGN PATENT DOCUMENTS

| | | |
|---|---|---|
| DE | 37 28 526 | 3/1989 |
| EP | 0 045 658 | 2/1982 |
| FR | 2 173 060 | 10/1973 |

OTHER PUBLICATIONS

Fabritius et al: "The Determination of the Minimun and Operational . . " ISIJ Int. 2003, BD. 43, No. 8, 2003, pp. 1177-1184, Dec. 2003.
Wei Ji-He et al: "Back-Attack Phenomena of Gas Jets with Submerged . . . " ISIJ Int 1999; BD. 39, No. 8, 1999, pp. 779-786, Dec. 1999.

* cited by examiner

*Primary Examiner*—Scott Kastler
(74) *Attorney, Agent, or Firm*—Friedrich Kueffner

(57) ABSTRACT

The aim of the invention is to damp or suppress oscillations (≦back-attack≧ effect) in sidewall or base blowing converters, used in particular to produce carbon steel or stainless steel. To achieve this, the gas supply system (3) for the converter comprises an inflow restrictor device (7), which is positioned upstream of or associated with the jets (5) and which periodically reduces or interrupts the gas supply to the interior of the furnace.

1 Claim, 6 Drawing Sheets

Pulsating Pressures Measured at Measuring Point V1, without valve

Pulsating Pressures Measured at Measuring Point V1, pulsation frequency adjusted to 7 Hz Pulsating Pressures Measured at Measuring Point V1, Pulsation Frequency adjusted to 20 Hz

GAS SUPPLY SYSTEM FOR A METALLURGICAL FURNACE AND OPERATING METHOD FOR SAID SYSTEM

The invention concerns a gas supply system and a method for operating a system of this type for a side blowing and/or a bottom blowing metallurgical furnace, especially a converter for producing carbon steels or stainless steels, with at least one tuyere, which is mounted in the side wall and/or in the bottom of the furnace, wherein gas is conveyed through a line to the tuyere and through the tuyere to the interior of the metallurgical furnace.

To produce stainless steels, it is well known that, for example, converters of the AOD type (Argon Oxygen Decarburization) with side-mounted tuyeres can be used, whereas to produce other grades of steel, it is also possible to use converters with bottom-mounted tuyeres. In both types of converter, various mixtures of oxygen and argon are supplied to the tuyeres. The tuyeres are located below the level of the metal bath in the blow position of the converter. During the operation of converters of this type, a phenomenon occurs, which has become known in the literature as "back attack" and has been demonstrated by high-speed photography.

The back-attack phenomenon is described in the article "Characteristics of Submerged Gas Jets and a New Type [of] Bottom Blowing Tuyere" by T. Aoki, S. Masuda, A. Hatono, and M. Taga, published in "Injection Phenomena in Extraction and Refining", edited by A. E. Wraith, April 1982, pages A1-36. This back-attack effect will now be described in greater detail with reference to FIGS. 5 and 6.

FIG. 5 shows a schematic representation of the individual sequences with respect to time in 5 stages after the entry of a gas jet into a molten metal and the back-attack effect.

In the first phase, the gas jet 101 enters the molten metal 103 approximately horizontally from the horizontally positioned tuyere 102 (FIG. 5, part 1). A column of gas bubbles 104 forms. In a second phase, the gas bubble expands farther into the interior of the molten metal 103 (FIG. 5, part 2). A constriction 105 then develops in the "stem" of the gas bubble, and a "collapse" occurs (FIG. 5, part 3), and finally the gas bubble 106 as a whole separates (FIG. 5, part 4). At this instant, the gas jet 101 strikes the wall of the cavity formed in the molten metal and is deflected back in the direction of the converter wall 107, which is made of refractory material; this constitutes the actual back attack. In part 5 of FIG. 5, the same state as in part 1 is reached again, and the process repeats itself.

This process known as back attack has a variety of negative effects. Impact stress occurs on the converter wall at a point perpendicular to the axis of rotation of the converter with a typical frequency of 2-12 Hz. This leads to vibrations of the converter vessel and its power train. The resulting micromotions in the converter bearings (usually conical roller bearings) and between the gear wheel and the split pinions in the converter gear unit result in frictional stress and rapid wear due to the inadequate formation of a lubricant film. The vibrations can also lead to vibration failures in the torque converter bearing of the converter gear unit and in the foundation supports if the latter are realized as a steel construction. This problem can be remedied with the present state of the art only by a reinforced design and enlargement of the bearings and by special locking mechanisms in the converter gear unit. However, both measures require large capital investments.

Besides the impact stress, strong erosion of the refractory wall of the converter is observed in the area surrounding the gas tuyeres. This effect could also be reproduced in a model experiment (see the above cited article in "Injection Phenomena in Extraction and Refining"). The converter model used for this purpose consisted of mortar for the refractory material and dilute hydrochloric acid as the melt. Air was blown in through a bottom nozzle. At a blowing pressure of both 4 $kg/cm^2$ and 50 $kg/cm^2$, the typically concavely shaped erosion depression developed around the nozzle, although the depression was larger at the lower blowing pressure.

The advancing wear in this zone limits the duration of a converter campaign to-typically 80-100 heats. After that, the entire refractory lining of the converter must be replaced, even though it would still have further useful life outside of the area of the tuyeres. This circumstance has a considerable effect on the economy of the converter process.

In addition, the large volume of the separating gas bubble results in an unfavorable, i.e., small, surface-to-volume ratio. Therefore, the reactions between the gas and the molten metal occur more slowly, the utilization, especially the oxygen utilization, is poorer, and the mixing effect between the molten metal and the slag floating on it is poor. This results in the need to use larger amounts of process gas and thus in higher operating costs.

Various methods have been published for weakening the back-attack effect or eliminating it to the greatest extent possible and thus removing the negative effects of back attack that have just been described. One such method (see the above-cited article in "Injection Phenomena in Extraction and Refining") consisted in changing from tuyeres with a circular cross section to tuyeres with a slot-shaped cross section. However, these tuyeres are more difficult to produce than circular tuyeres. Therefore, they are more expensive and also more difficult to install. Furthermore, it is practically impossible to produce reliable slot tuyeres with an annular gap. Depending on the pressure difference between the inner pipe and the annular gap, the inner pipe expands differently, and the cross section of the annular gap undergoes unwanted and nonuniform changes. For these reasons, this method has not gained acceptance.

In the aforementioned model experiment, the blowing pressure was raised above the customary 15 bars (at which the impact stress happens to be greatest) to values as high as 80 $kg/cm^2$ (see also the above-cited article in "Injection Phenomena in Extraction and Refining"). The resulting conditions are shown in FIG. 6. The graph shows the effect of increasing blowing pressure on the back-attack effect with a circular nozzle with an inside diameter of 1.7 mm. This model involved the blowing of nitrogen in water. With increasing blowing pressure, the frequency of the back attack drops significantly, because the gas bubble extends over a greater distance. The cumulative jet pulse initially rises with increasing blowing pressure and then also starts to decline at a blowing pressure of about 15 $kg/cm^2$.

Another method for influencing the back-attack effect consists in the use of a ring tuyere with or without spiral swirl vanes (see "Back-Attack Action of Gas Jets with Submerged Horizontally Blowing and Its Effects on Erosion and Wear of Refractory Lining," J.-H. Wei, J.-C. Ma, Y.-Y. Fan, N.-W. Yu, S.-L. Yang, and S.-H. Xiang, 2000 Ironmaking Conference Proceedings, pp. 559-569). In this method, the spiral swirl vanes impart rotational motion to the gas jet, which is intended to produce more thorough bath mixing and smaller bubbles and thus less intense back attack, less wear of the refractory lining, and better gas utilization. The higher pressure loss of the tuyeres with spiral swirl vanes is seen as a disadvantage. This requires an increase in the gas admission pressure, which is not possible in all cases.

Proceeding on the basis of this prior art, the objective of the invention is to moderate or eliminate the back-attack effect in metallurgical furnaces without the disadvantages described above.

It is proposed that the gas supply system of the metallurgical furnace have an inflow restrictor, which is assigned to the tuyere or is positioned upstream of the tuyere and periodically reduces or interrupts the gas supply to the interior of the furnace. This means that the gas bubble can separate from the tip of the tuyere at much shorter time intervals than in the case of conventional, uninterrupted gas flow. Consequently, smaller bubbles form right from the start, and the reactive effects of back attack on the wall of the vessel are much smaller. At the same time, the gas bubbles have a higher surface-to-volume ratio.

With respect to the method, it is proposed that the gas flow into the interior of the furnace be periodically reduced or interrupted with frequencies above about 5 Hz, so that the gas flow is divided into smaller volume units. It was found that starting at a switching frequency of the inflow restrictor of about 5 Hz, there is a significant reduction of the maximum pressure amplitudes at approximately the same frequency. This favorable reduction of the pressure amplitudes can be intensified with increasing switching frequency with very favorable results at a switching frequency of, for example, 20 Hz and higher.

The inflow restrictor is installed in the gas supply line to the tuyeres and as close as possible to the mouth of the tuyere.

In principle, any type of inflow restrictor device or gas-flow unit can be used. In particular, it is proposed that a mechanical device be used, preferably a solenoid valve or a servovalve.

The inflow restrictors are preferably installed in such a way that they can be bypassed. For this purpose, the system has bypass lines that can be closed and that are assigned to the respective lines in which the inflow restrictors are integrated. This makes it possible to convey the gas stream only through the bypass lines during certain blowing phases, for example, during phases with a blowing rate in which the back-attack effect is not so pronounced, and to dispense with gas flow regulation by the inflow restrictors. At the same time, with an arrangement of this type, it is possible to continue the operation in the event of a failure of one or more of the inflow restrictors.

In addition, it is proposed that several inflow restrictors be coordinated with one another or timed in their operation. Several inflow restrictors together with the corresponding tuyeres are to be operated either in phase or out of phase. A suitable control unit for the inflow restrictors is provided for this purpose.

The invention is explained in greater detail below with reference to the drawings.

Figure 6:
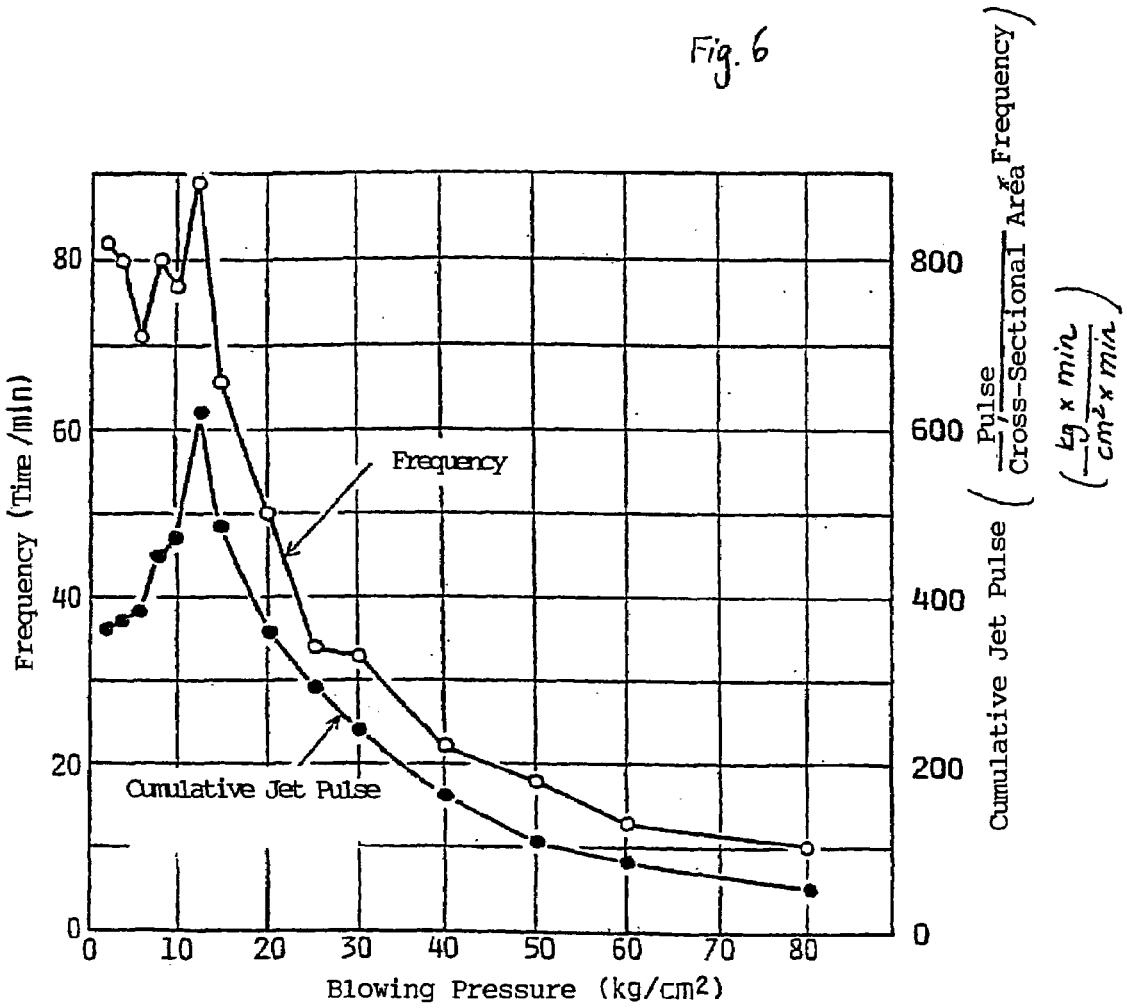

FIG. 6 shows a graph of the back-attack frequency as a function of the gas blowing pressure from "Injection Phenomena in Extraction and Refining," edited by A. E. Wraith, April 1982, pp. A1-36.

Figure 1:
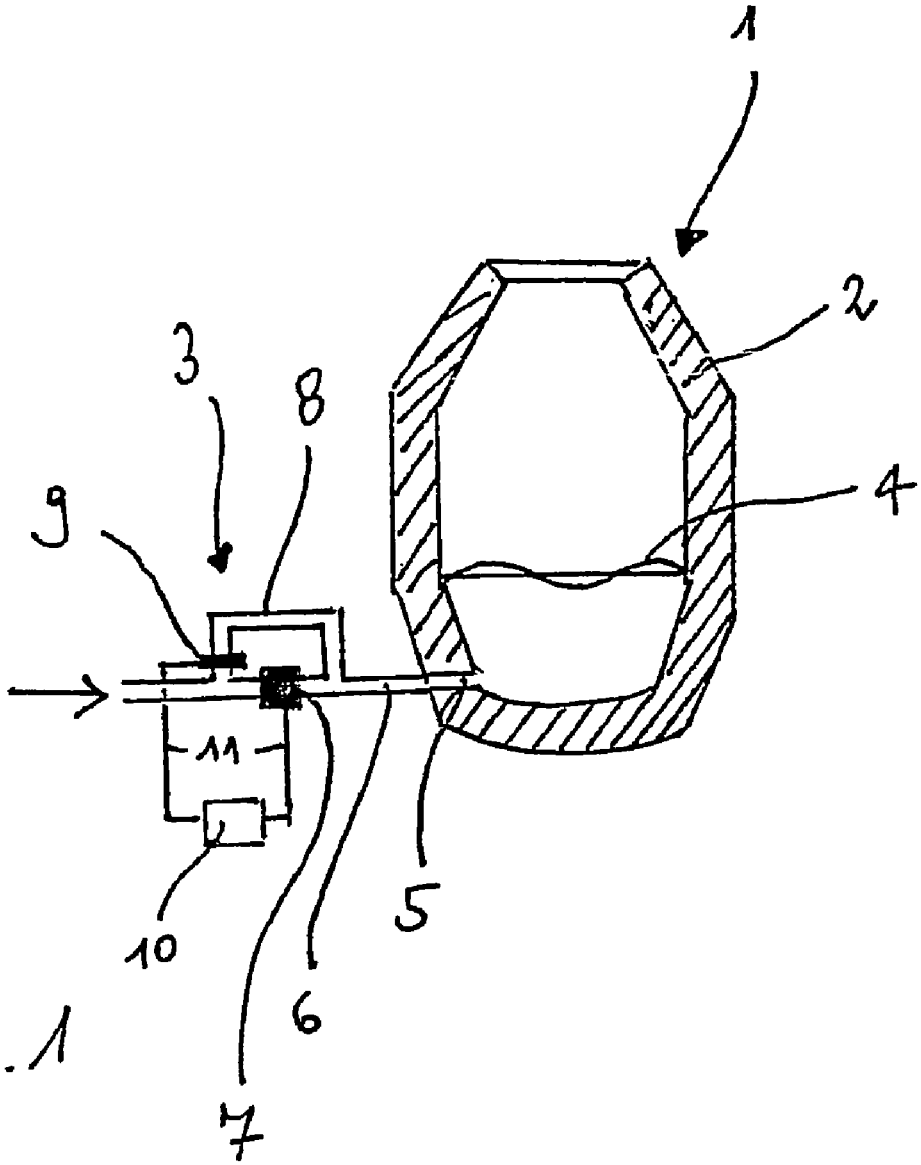
FIG. 1 shows a schematic representation of a metallurgical furnace with a gas supply system in accordance with the invention.

FIG. 1 shows a schematic representation of a gas supply system 3 for reducing or preventing the back-attack effect for the example of a converter 1 with refractory lining 2. In a converter with side-mounted tuyeres, several (submerged) tuyeres are mounted in the wall of the converter and are located below the bath surface 4 when the converter 1 is placed in a vertical position. FIG. 1 shows only one of the tuyeres 5 as an example. The tuyere 5 extends horizontally through the refractory lining 2 of the furnace. The tuyere 5 is part of the gas supply system 3, which also has gas lines 6, in each of which an inflow restrictor 7 (here a solenoid valve or a servovalve) is integrated. The inflow restrictor 7 is mounted as close as possible to the mouth of the tuyere. The gas supply to the interior of the furnace or the molten metal bath is periodically or regularly reduced or completely interrupted for a short period of time by the inflow restrictor 7. The gas supply system 7 has bypass lines 8 parallel to the gas lines 6. Each bypass line 8 can be closed or opened by a shutoff device 9. In the open state, the inflow restrictor 7 or the shutoff device 9 is then closed. A control unit 10 controls the valve and the shutoff device 9 and is connected with the valve and the shutoff device 9 by control wires 11. The control unit 10 also controls the adjustment of individual valves of neighboring supply lines for several tuyeres as well as the shutoff devices of the bypass lines.

Figure 2:
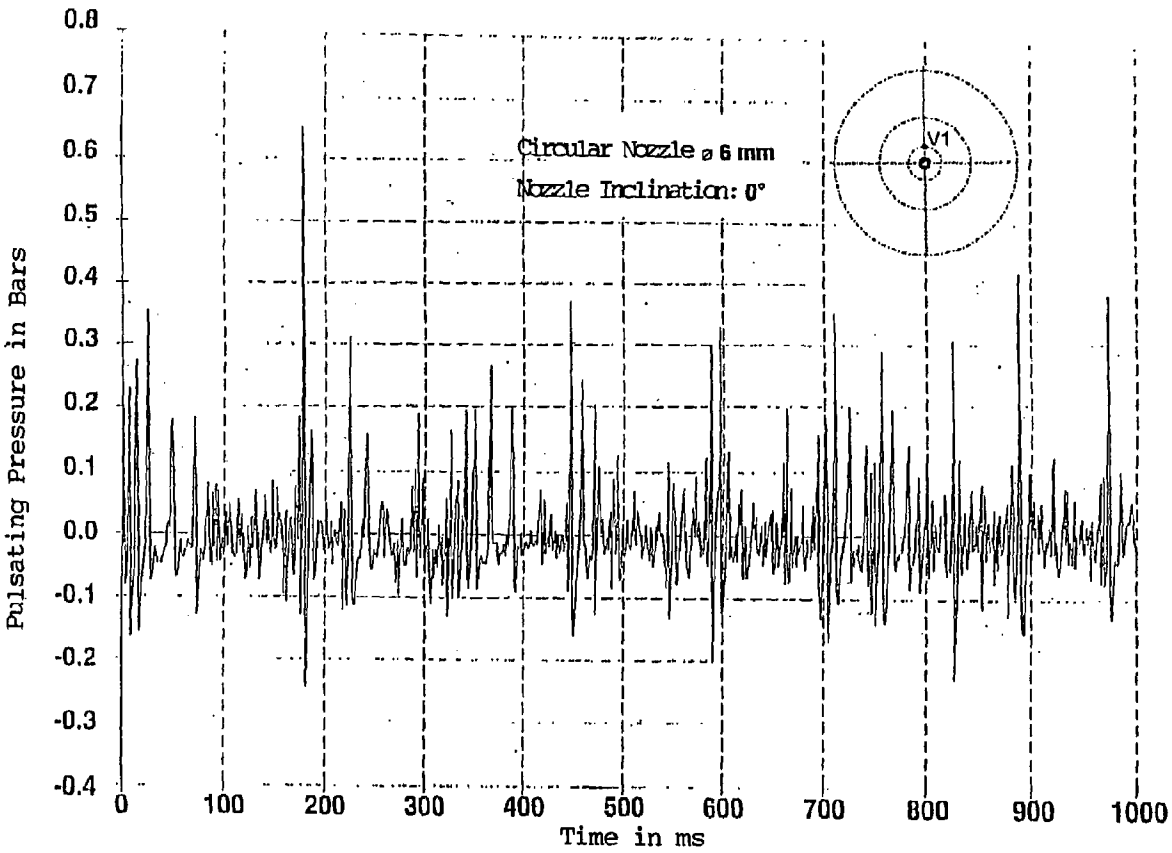
FIG. 2 shows a graph of the pulsating pressure as a function of time for a prior-art gas supply system with a tuyere without a valve.
Figure 3:
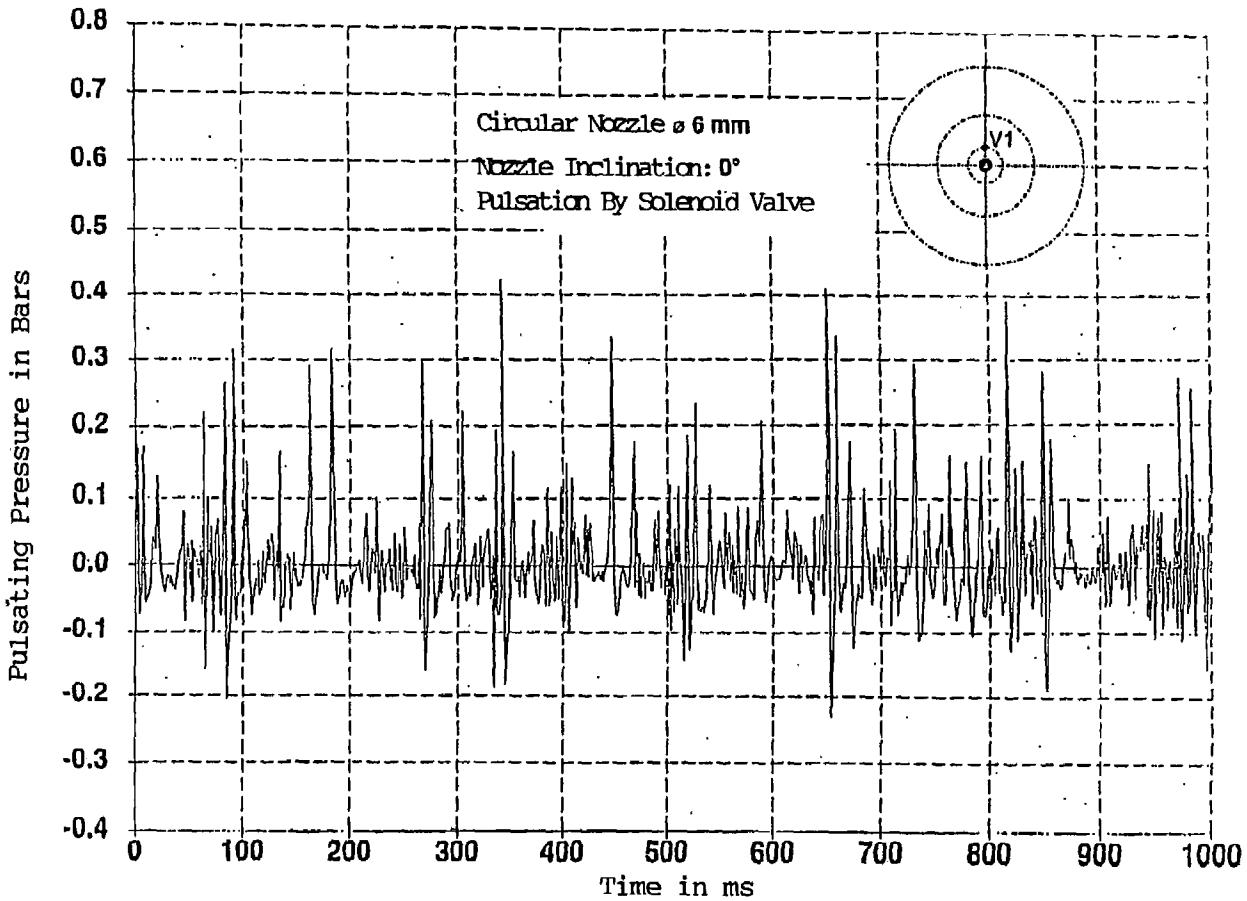
FIG. 3 shows a corresponding graph of the pulsating, pressure as a function of time for a gas supply system in accordance with the invention with pulsation by a solenoid valve.
Figure 4:
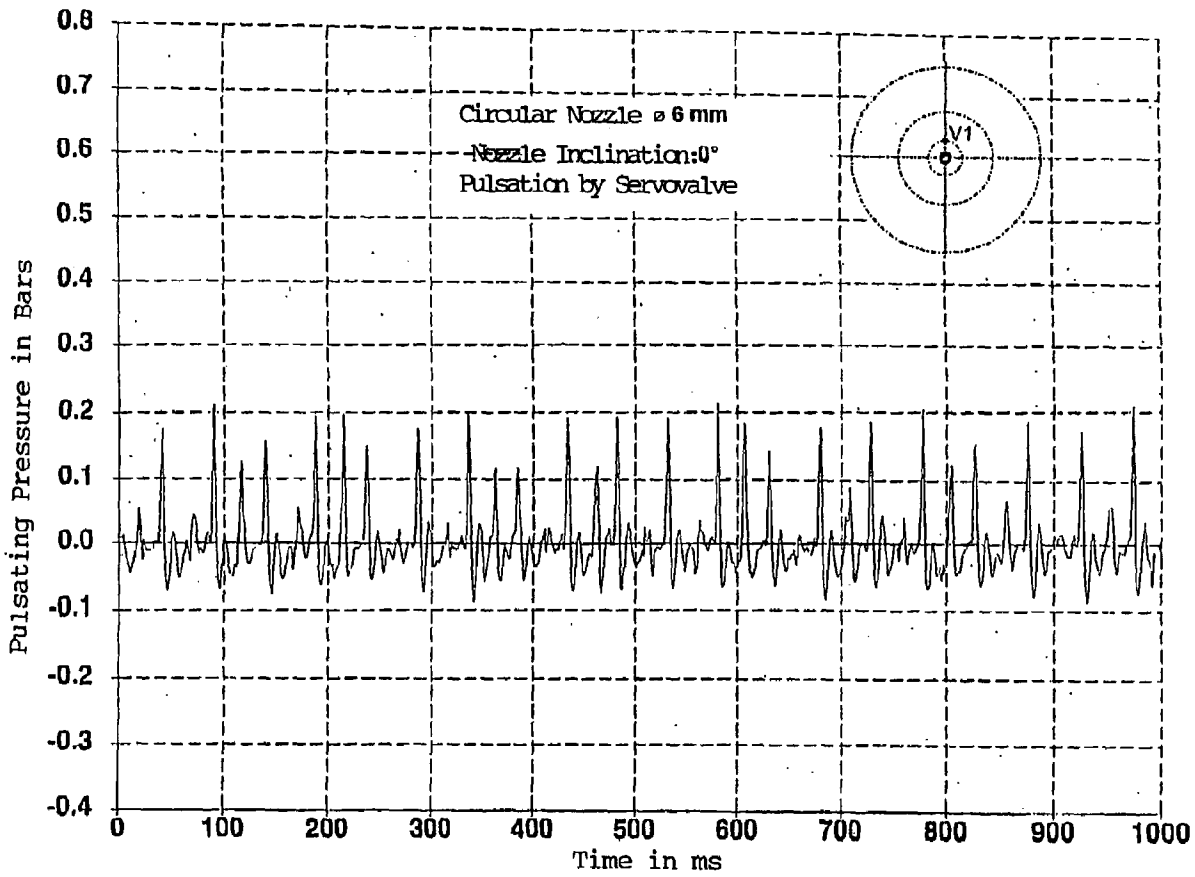
FIG. 4 shows a graph of the pulsating pressure as a function of time for a gas supply system in accordance with the invention with pulsation by a servovalve.
Figure 5:
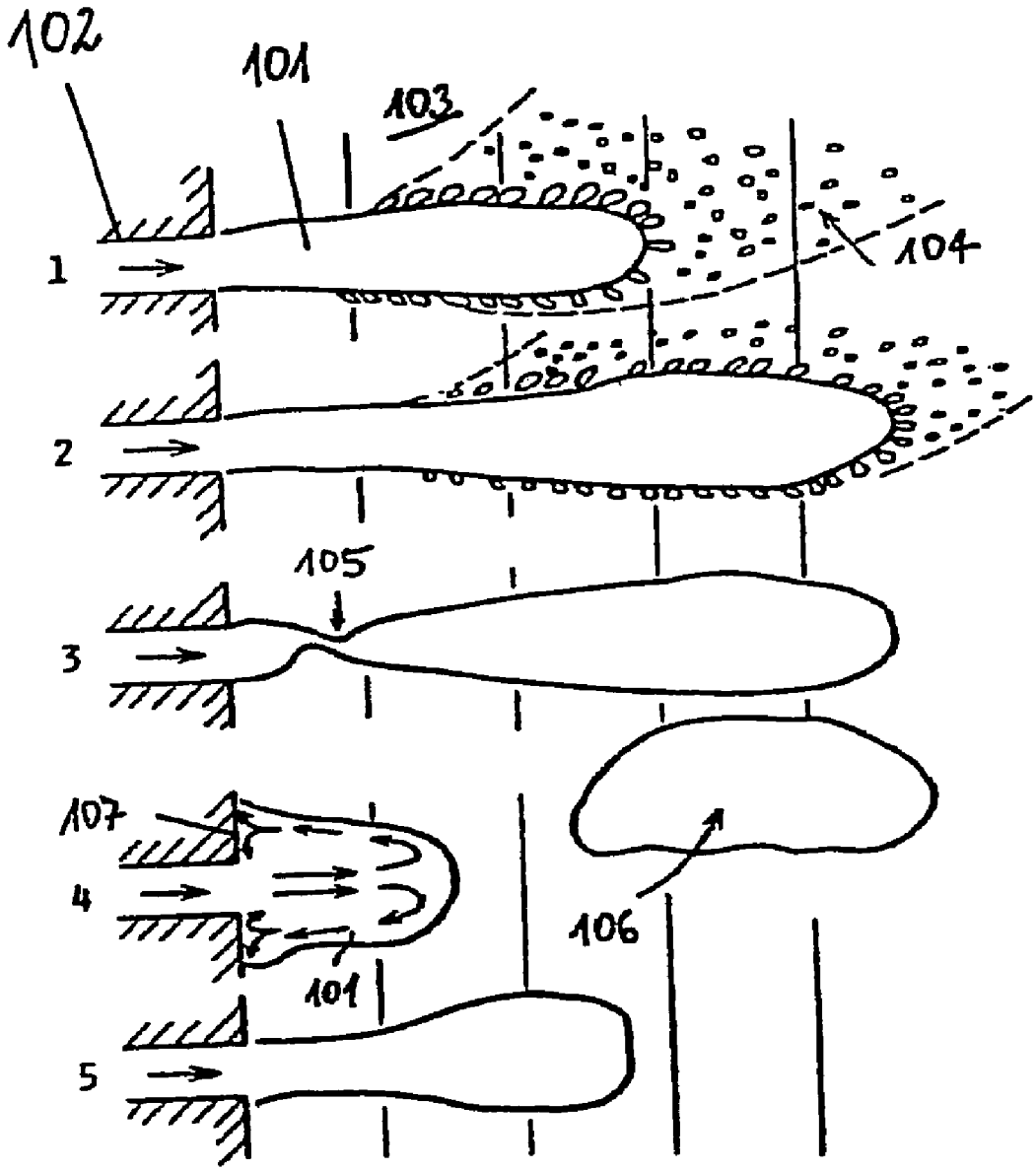
FIG. 5 shows a schematic representation of the mechanism of the back-attack phenomenon.

FIGS. 2 to 4 show results of model experiments in a circular water tank, in which the pressure surges (pulsating pressure in bars) on the wall of the vessel were measured with a special sensor as a function of the time in ms. A circular nozzle with a diameter of 6 mm and a nozzle inclination of 0° was used in all of the tests. The inset in each of FIGS. 2 to 4 shows the nozzle with its radial zone of influence on the wall of the vessel. The measuring sensor is positioned at point V1. First, nozzles without a valve show the typical appearance of back attack (see FIG. 2). Even above a switching frequency of the solenoid valve of only 5 Hz, there was a definite reduction of the maximum pressure amplitudes at approximately the same frequency, here a pulsation frequency of 7 Hz (FIG. 3). The best results were obtained with a switching frequency of 20 Hz, which at the same time is the maximum switching frequency for the solenoid valve that was used. All together, the stress amplitudes of the back attack become smaller with increasing pulsation frequency.

The back-attack effect can thus be significantly reduced by pulsation of the gas stream. All together, mechanical vibrations that have previously been observed in bottom blowing or side blowing converters for producing carbon steels or stainless steels can be weakened or suppressed in this way. Wear of the refractory material or brickwork in the zone around the tuyere is suppressed. In addition, mass transfer between the gas phase and the liquid phase in the converter is improved.

LIST OF REFERENCE NUMBERS

1 converter
2 refractory lining
3 gas supply system
4 bath surface
5 tuyere
6 gas line

7 inflow restrictor (valve)
8 bypass line
9 shutoff device
10 control unit
11 control wires
10 gas jet
102 tuyere
103 molten metal
104 column of gas bubbles
105 constriction
106 gas bubble
107 converter wall

The invention claimed is:

1. Method for operating a gas supply system for a side blowing and/or bottom blowing metallurgical furnace with at least one tuyere (5), which is mounted in the side wall and/or in the bottom of the furnace, wherein gas is conveyed through a line (6) of the gas supply system (3) and through the tuyere (5) to the interior of the metallurgical furnace and emerges there in the form of bubbles, wherein the flow of gas into the interior of the furnace is periodically reduced or interrupted at frequencies greater than 5 Hz.

* * * * *